US009420869B2

(12) United States Patent
Huang et al.

(10) Patent No.: US 9,420,869 B2
(45) Date of Patent: Aug. 23, 2016

(54) REFILLABLE LIPSTICK

(76) Inventors: Kuo Yu Huang, Guangzhou (CN); Zoilo Luis Alviar, Everett, WA (US)

( * ) Notice: Subject to any disclaimer, the term of this patent is extended or adjusted under 35 U.S.C. 154(b) by 153 days.

(21) Appl. No.: 14/360,920

(22) PCT Filed: Dec. 12, 2011

(86) PCT No.: PCT/CN2011/083820
§ 371 (c)(1),
(2), (4) Date: May 27, 2014

(87) PCT Pub. No.: WO2013/086669
PCT Pub. Date: Jun. 20, 2013

(65) Prior Publication Data

US 2015/0110539 A1 Apr. 23, 2015

(51) Int. Cl.

| | |
|---|---|
| ***B43K 21/00*** | (2006.01) |
| ***A45D 40/14*** | (2006.01) |
| ***A45D 40/06*** | (2006.01) |
| ***A45D 40/16*** | (2006.01) |

(52) U.S. Cl.
CPC ..... *A45D 40/14* (2013.01); *A45D 40/06* (2013.01); *A45D 40/16* (2013.01); *Y10T 29/49817* (2015.01); *Y10T 29/49826* (2015.01)

(58) Field of Classification Search
CPC ..... A45D 40/00; A45D 40/02; A45D 40/06; A45D 40/14; A45D 40/16; A45D 40/24; A45D 2040/0018; A45D 2040/0043
See application file for complete search history.

(56) References Cited

U.S. PATENT DOCUMENTS

| | | | | |
|---|---|---|---|---|
| 3,216,563 A * | 11/1965 | Finkenzeller | ..... | A45D 40/04 401/76 |
| 5,468,084 A | 11/1995 | Boninsegni et al. | | |
| 2010/0183355 A1 | 7/2010 | Pires et al. | | |

FOREIGN PATENT DOCUMENTS

| | | | | |
|---|---|---|---|---|
| CN | 201438890 U | 4/2010 | | |
| CN | 201718697 U | 1/2011 | | |
| JP | 2006271757 A | 10/2006 | | |
| KR | 100965241 B1 | 6/2010 | | |
| WO | WO 2014073819 A1 * | 5/2014 | ..... | A45D 40/00 |

OTHER PUBLICATIONS

PCT/CN2011/083820, International Search Report and Written Opinion of the International Searching Authority, Sep. 20, 2012, 9 pages.

* cited by examiner

*Primary Examiner* — Jennifer C Chiang
(74) *Attorney, Agent, or Firm* — Timberline Patent Law Group

(57) ABSTRACT

A refillable lipstick is provided. In one implementation, a high-quality permanent lipstick dispenser incorporates a magnetic catch that enables replacement of the lipstick within the dispenser. Lipstick refills may be installed and removed from the dispenser with a refill cap that has an extraction lever. The refill cap may be made decorative. In one implementation, the refill cap and extraction lever make and break an attachment between a magnetic cup provided with the lipstick and the magnetic catch inside the permanent decorative dispenser. In an implementation, a swivel-up dispenser extends and retracts the lipstick. At extension, the user can twist a derailer, which then provides an additional groove for further extending and raising the lipstick from the dispenser for removal by the refill cap. A working cap is provided to cap the lipstick between refills. An exemplary kit contains a swivel-up dispenser, custom decorative outer shell and trim for the dispenser, one or more alternate lipsticks in one or more refill caps with extractors, and a working cap.

11 Claims, 9 Drawing Sheets

REFILLABLE LIPSTICK

BACKGROUND

Lipstick for adding color, texture, and protection to the lips has been available in cylindrical metal tubes since 1915. Classic problems with lipstick containers include losing the lipstick cap when the lipstick is jostled in a purse, and having the lipstick melt from the heat of the sun.

Lipstick tubes have improved to address some of these problems. However, a user conventionally must buy the lipstick dispensing tube with the lipstick, adding significant cost. The lipstick container has become so associated with the lipstick product it contains that the dispensing tube itself is also referred to as a "lipstick." The marketing of lipstick often becomes marketing of the dispenser tube. Since the cost of the lipstick and dispenser combination is relatively high, a manufacturer may limit the number of lipstick types or lipstick colors to be offered, to avoid an overstock of relatively expensive dispensers containing less popular lipstick colors or shade variations.

SUMMARY

A refillable lipstick is provided. In one implementation, a high-quality permanent lipstick dispenser incorporates a magnetic catch that enables replacement of the lipstick within the dispenser. Lipstick refills may be installed and removed from the dispenser with a refill cap that has an extraction lever. The refill cap may be made decorative. In one implementation, the refill cap and extraction lever make and break an attachment between a magnetic cup provided with the lipstick and the magnetic catch inside the permanent decorative dispenser. In an implementation, a swivel-up dispenser extends and retracts the lipstick. At extension, the user can twist a derailer, which then provides an additional groove for further extending and raising the lipstick from the dispenser for removal by the refill cap. A working cap is provided to cap the lipstick between refills. An exemplary kit contains a swivel-up dispenser, custom decorative outer shell and trim for the dispenser, one or more alternate lipsticks in one or more refill caps with extractors, and a working cap.

This summary section is not intended to give a full description of a refillable lipstick, or to provide a list of features and elements. A detailed description of example embodiments follows.

DETAILED DESCRIPTION

Overview

Figure 1:
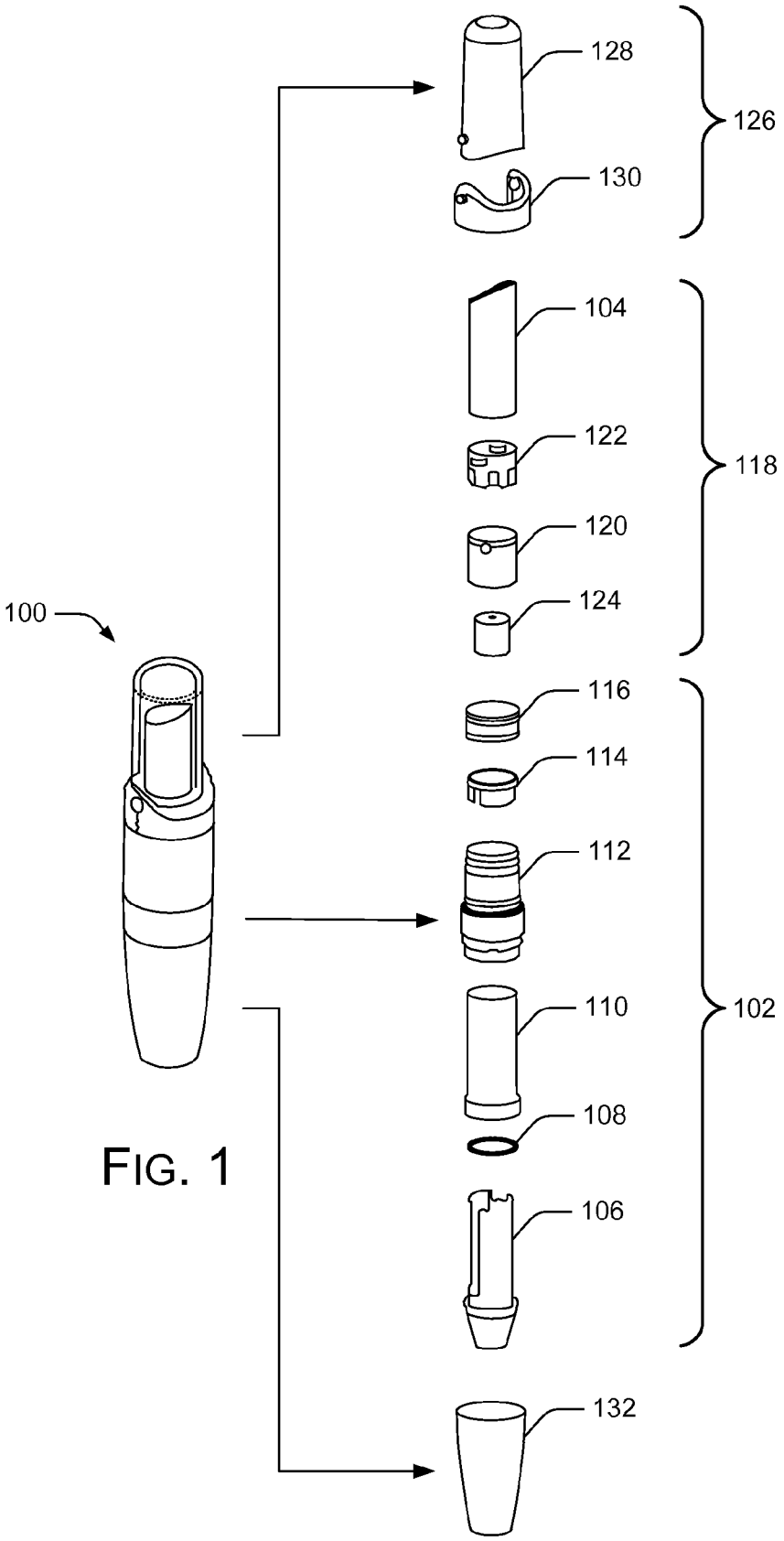
FIG. 1 is a diagram of an example refillable lipstick dispenser.

This disclosure describes an example refillable lipstick. In one implementation, an example refillable lipstick provides a high-quality, permanent, decorative pen-like lipstick dispenser that can be refilled with new lipsticks at will. The new lipsticks may be the same as the lipstick being refilled, or the refill may be of different composition, color, texture, gloss, flavor, and so forth, than the lipstick being replaced or refilled.

The example refillable lipstick reduces the cost of buying lipstick over time, and enables a manufacturer to offer a wider selection of lipstick colors, textures, and types. If a given lipstick is depleted or damaged, the tube dispenser does not have to be discarded, and a new lipstick tube dispenser does not have to be purchased. This saves resources and the environment, and can be economical for the lipstick user, while potentially providing the lipstick user with a high-quality lipstick dispenser that can be customized and ornamented to be jewelry-like.

The refillable lipstick dispenser incorporates a mechanism for holding and releasing a given lipstick. In an implementation, the holding mechanism is a magnetic catch that secures and enables replacement of the lipstick within the dispenser. Alternatively, a friction fit, bayonet fitting, or other technique may be used to hold and release a given lipstick. A charge, portion, segment, or stick of lipstick constituting a lipstick refill will be referred to herein simply as a "lipstick." In an implementation, a derailer moves the lipstick into extraction position at the top of a swivel-up mechanism when the user twists an outer sleeve. A groove on the derailer aligns with a groove on the inner guide sleeve to allow the guide pins of a lipstick carrier to extend up further away from the main dispenser. This exposes the lipstick payload for access and removal by an extractor on a refill cap. Otherwise, when not in extraction position, the lipstick is held firmly by the refillable lipstick dispenser for extension, retraction, and application to the user's lips.

Lipstick refills may be installed and removed from the dispenser with a refill cap that has an extraction lever. The refill cap and the extraction lever may be made decorative to match the decorative theme of the overall lipstick dispenser. For example, a chrome extraction lever and colored transparent refill cap may match the color and trim of the overall lipstick dispenser. Functionally, in one implementation, the refill cap and extraction lever make and break an attachment between the magnetic catch inside the decorative lipstick dispenser and a disposable magnetic cup holding the current lipstick.

In an implementation, a swivel-up version of the dispenser extends and retracts the lipstick, securing the lipstick so that a refill may be made only when the lipstick is fully extended from the decorative dispenser. A top or "working cap" is provided to cap the lipstick between refills. The refillable lipstick may be provided in a kit that contains any combination of a swivel-up dispenser with magnetic catch, custom decorative outer shells and trim for the dispenser, one or more alternate lipsticks in one or more refill caps with extractors, and a working cap.

Example Implementations

FIG. 1 shows an example refillable lipstick dispenser 100, with integrated and exploded views. In one implementation, an example refillable lipstick dispenser 100 has a swivel-up mechanism 102 for containing and handling the lipstick 104. In this implementation, the swivel-up mechanism 102 has a tubular member 106, such as an inner guide sleeve, an O-ring 108 or other grommet to space and to dampen twisting motions, a spiral sleeve 110, an outer shell 112, a derailer 114, and a derailer sleeve 116.

In an implementation, a moving payload 118 consists of a carrier 120, cup 122, the lipstick 104, and a magnet 124 or magnetized element. The carrier 120 rides in a rail or slot in the tubular member 106. The cup 122 holds and grasps the lipstick 104 and removably attaches to the carrier 120. The cup 122 may be constructed of a magnetic material, such as steel containing iron, and held to the carrier 120 by the magnet 124, which may be incorporated in the carrier 120 or otherwise associated with the carrier 120.

A refill cap 126 has a cover 128 that is attachable to the main body of the refillable lipstick 100, such as to the outer shell 112, the derailer sleeve 116, or other parts of the example swivel-up mechanism 102. The refill cap 126 has an extractor 130, which the user moves in or out in relation to the cover 128 to extract or install a new lipstick 104 being refilled.

In one implementation, a user twists or rotates the refill cap 126 once it is placed on the main body of the refillable lipstick dispenser 100 to engage the derailer sleeve 116 and bring the carrier 120 and cup 122 into position to extract and refill the lipstick 104. The user then pushes the extractor 130 towards the main body to secure the used lipstick in the refill cap 126 for extraction. In one implementation, movement of the extractor 130 alone installs or extracts a lipstick 104 being refilled.

A base cover 132 fits over the bottom of the tubular member 106 and provides a customizable decorative shell for the lower part of the refillable lipstick dispenser 100.

Figure 2:
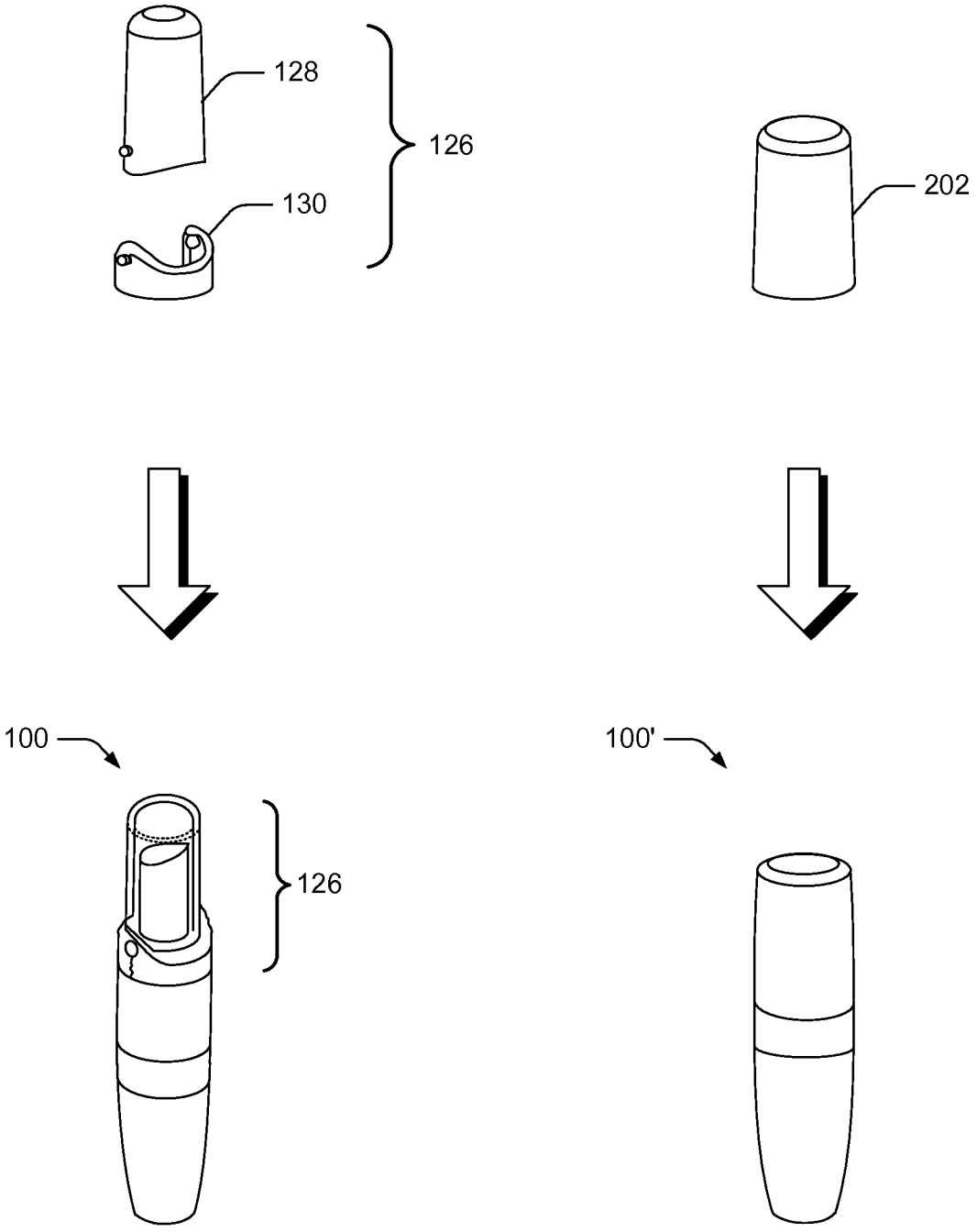
FIG. 2 is a diagram showing a refill cap and a working cap for the example refillable lipstick dispenser.

FIG. 2 shows attachment of the refill cap 126 and attachment of a working cap 202 to the main body of the refillable lipstick dispenser 100. The working cap 202 may be customized to match a decorative theme of the overall refillable lipstick dispenser 100 and 100', especially an artistic theme of the base cover 132 and the visible portions of the outer shell 112 and refill cap 126. The working cap 202 provides a cover for the lipstick during everyday use, when the lipstick 104 is not being refilled. In an implementation, the working cap 202 attaches to the main body of the refillable lipstick dispenser 100' when the lipstick 104 is fully retracted into the tubular member 106. The refill cap 126, by comparison, attaches to the main body of the refillable lipstick dispenser 100 to be used when the lipstick 104 is fully extended from the tubular member 106.

Figure 3:
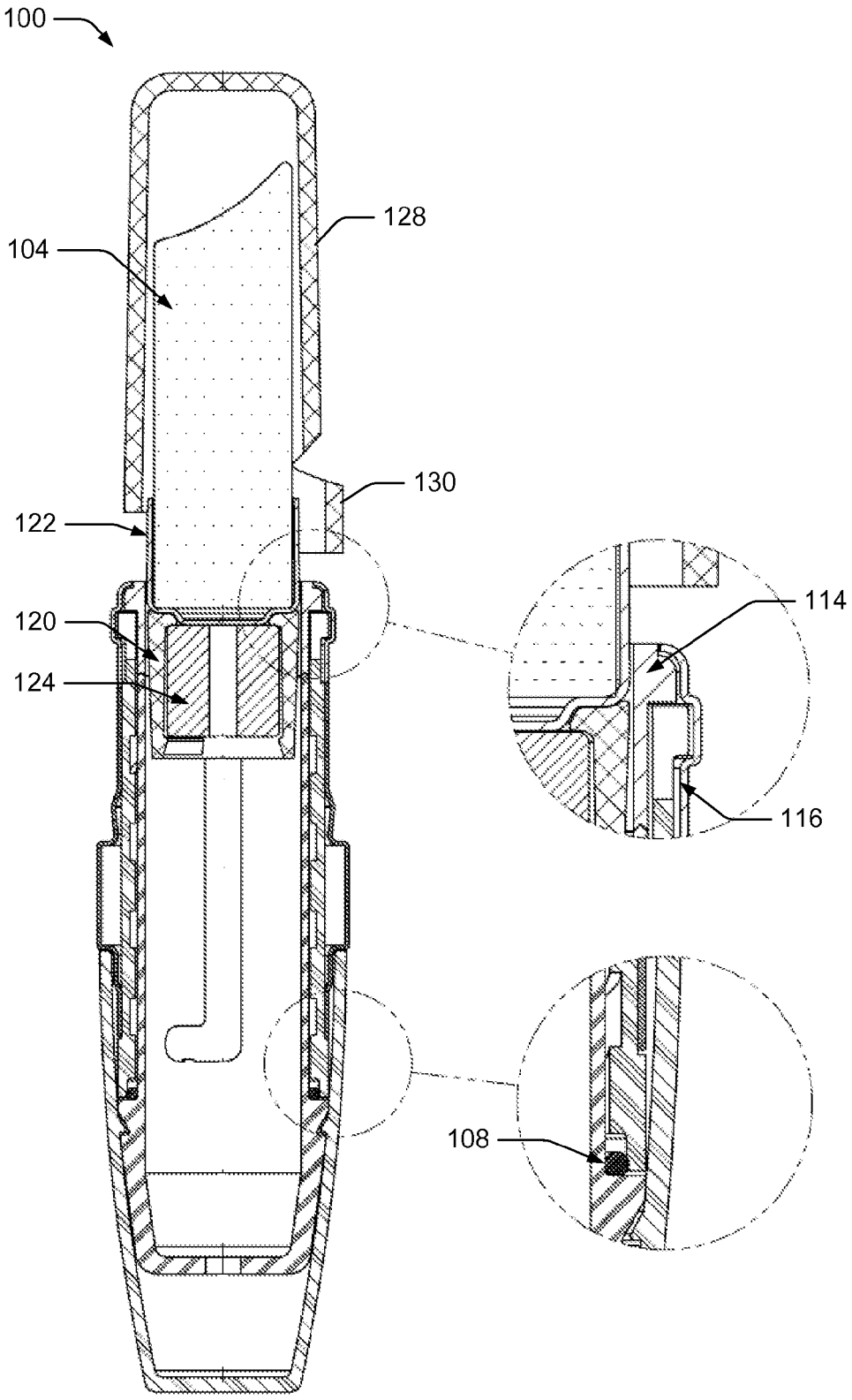
FIG. 3 is a cross-sectional view of the example refillable lipstick dispenser with the lipstick fully extended for installation or extraction.

FIG. 3 shows a cross section of the example refillable lipstick dispenser 100, with the moving payload 118 extended for a lipstick refill. The extractor 130 is shown in an open position, allowing the cup 122 holding the lipstick 104 to magnetically seat on the carrier 120 and the magnet 124, guided by an inner sleeve of the tubular member 106.

Figure 4:
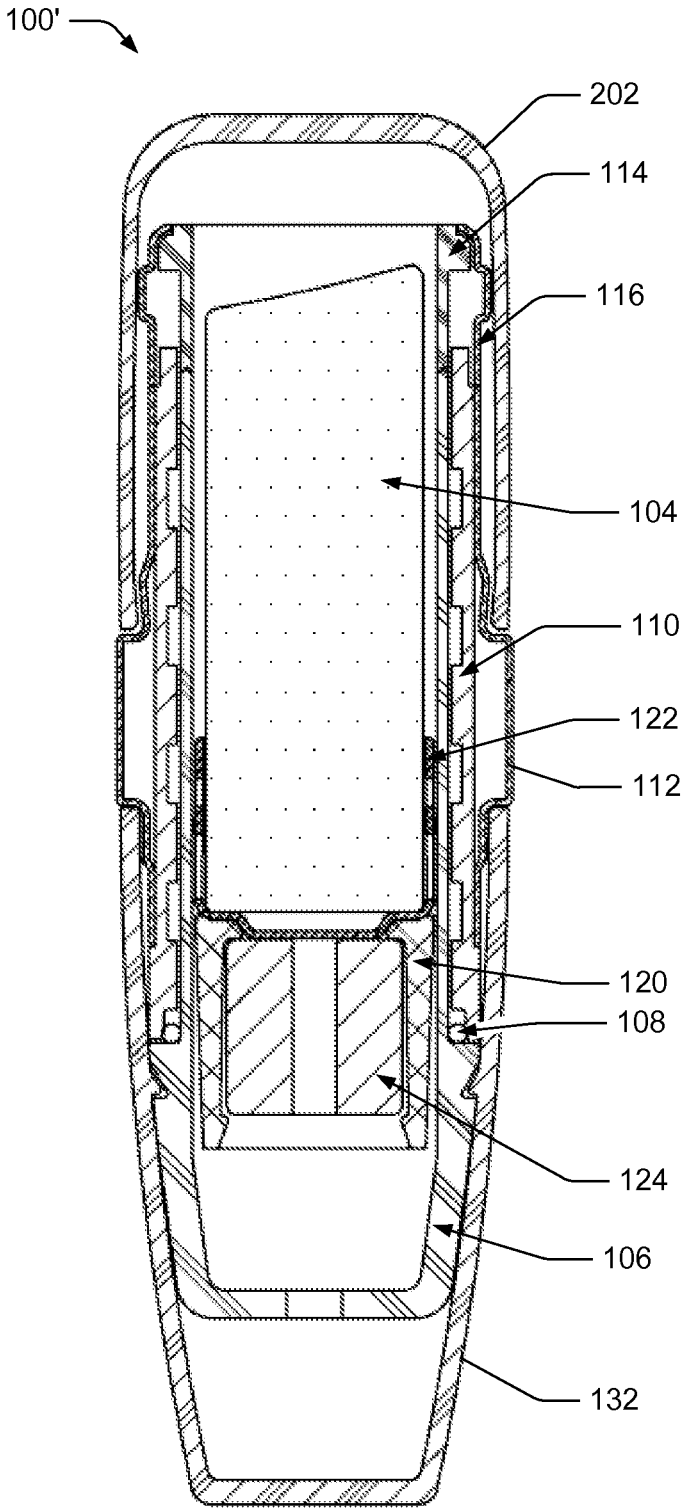
FIG. 4 is a cross-sectional view of the example refillable lipstick dispenser with the lipstick fully retracted and the working cap secured.

FIG. 4 shows a cross section of the refillable lipstick dispenser 100 with the moving payload 118 retracted. The carrier 120, magnet 124, cup 122, and lipstick 104 are fully enclosed within the tubular member 106 during retraction, and the working cap 202 can then be attached at the top to protect the lipstick 104.

Figure 5:
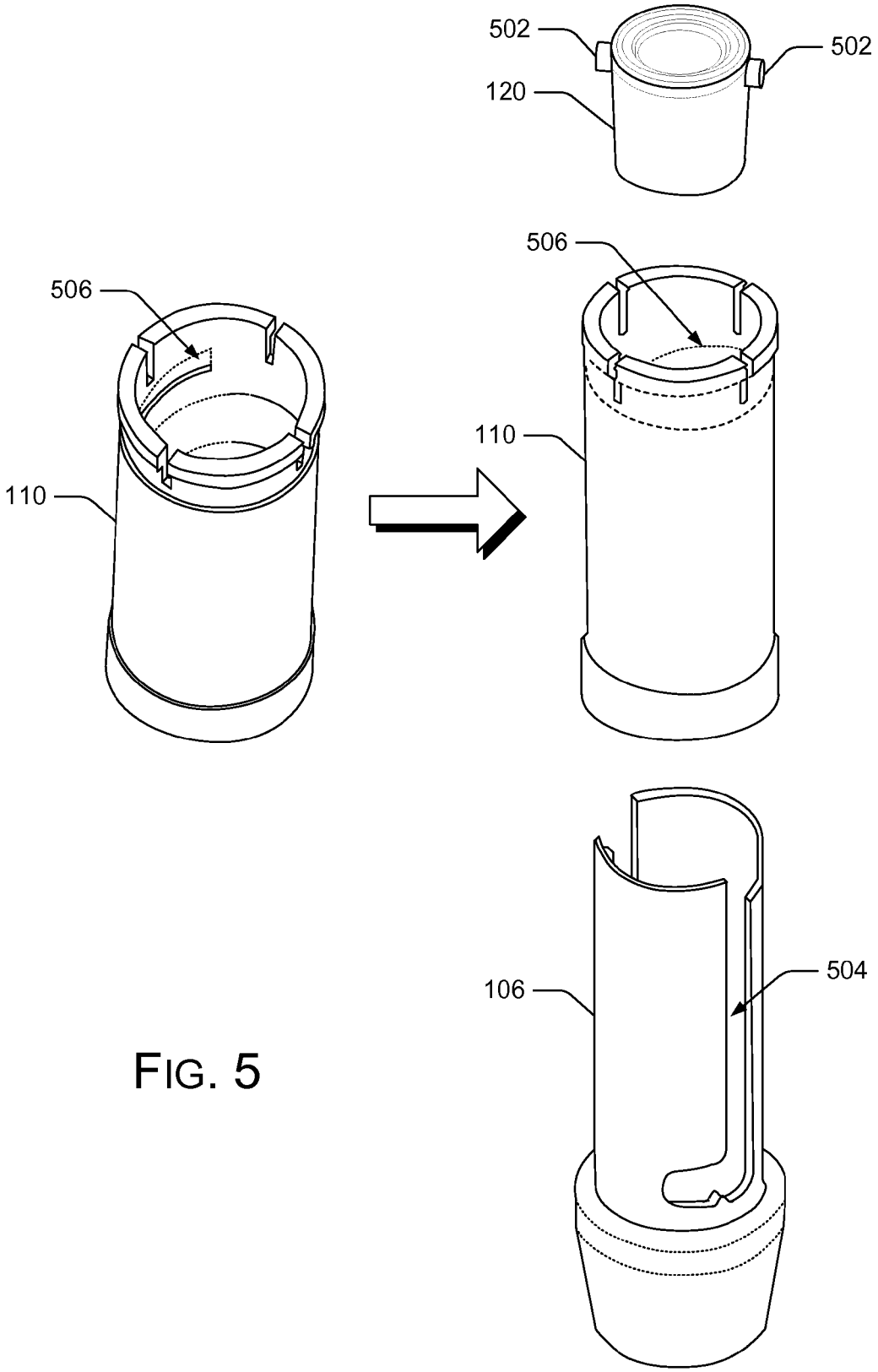
FIG. 5 is a diagram of an example swivel-up implementation of the example refillable lipstick dispenser.

FIG. 5 shows exploded elements of an example swivel-up mechanism 102 of the refillable lipstick dispenser 100. In an implementation, the carrier 120 has pins 502 that engage corresponding slots 504, rails, or keyways in the tubular member 106, shown as an inner guide sleeve. The spiral sleeve 110 has a second corkscrewed spiral slot 506, rail, or keyway on its inner surface that also engages the pins 502 of the carrier 120. Thus, when the spiral sleeve 110 is rotated around the tubular member 106, the carrier 120 is raised or lowered by screw motion depending on the direction of rotation of the spiral sleeve 110. However, the carrier 120 only moves straight up and down because of the straight slots 504 of the tubular member 106. In one implementation, the spiral sleeve 110 is rotated around the tubular member 106 by the user twisting the bottom cap 132 with respect to the outer shell 112 and spiral sleeve 110, or vice versa.

Figure 6:
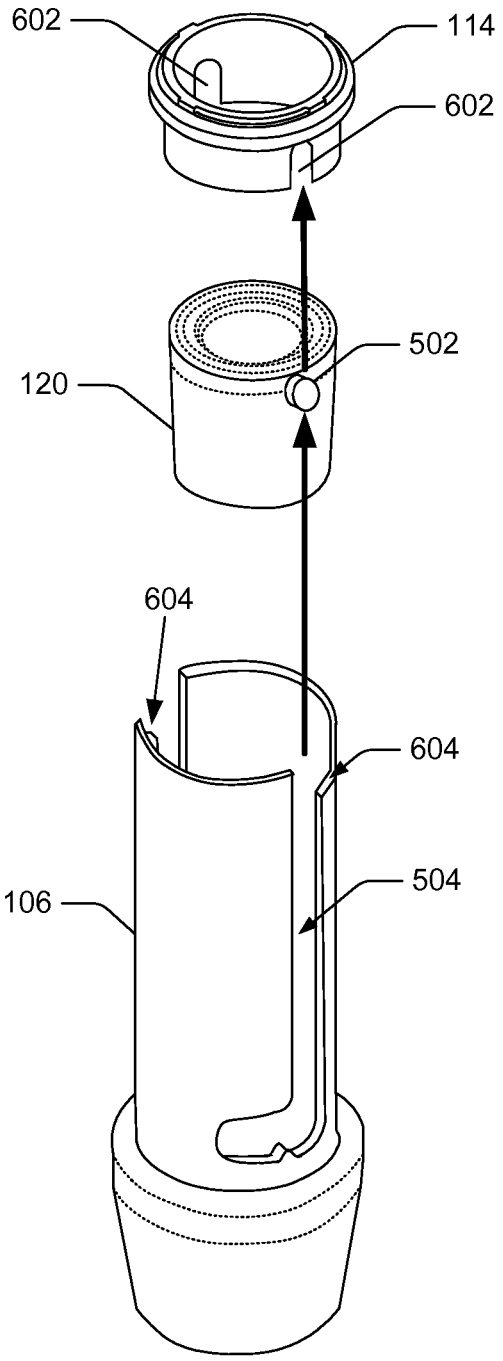
FIG. 6 is a diagram of an example derailer and example derailer functionality.

FIG. 6 shows the example derailer 114 in relation to the carrier 120 and the tubular member 106. In an implementation, the tubular member 106 is a guide sleeve with corresponding slots 504 for the guide pins 502 of the carrier 120. The derailer 114 can be twisted (e.g., rotated) by the user in relation to the main body of the dispenser to align extension grooves 602 on the derailer 114 with the slots 504 on the tubular member 106. When twisted into this position, the derailer 114 provides extra track for the guide pins 502 of the carrier 120 to move up and further away from the main body of the tubular member 106.

In one implementation, rotation of the derailer 114 in relation to the tubular member 106, or vice versa, also lifts the carrier 120 via the guide pins 502 into the grooves 602 on the derailer 114 through cam action of a ramp or shelf 604 incorporated into the slots 504 of the tubular member 106. Once lifted into the grooves 602 of the derailer 114, the cup 122 and the lipstick payload 104 can be removed from the main dispenser by the extractor 130 of the refill cap 126.

Figure 7:
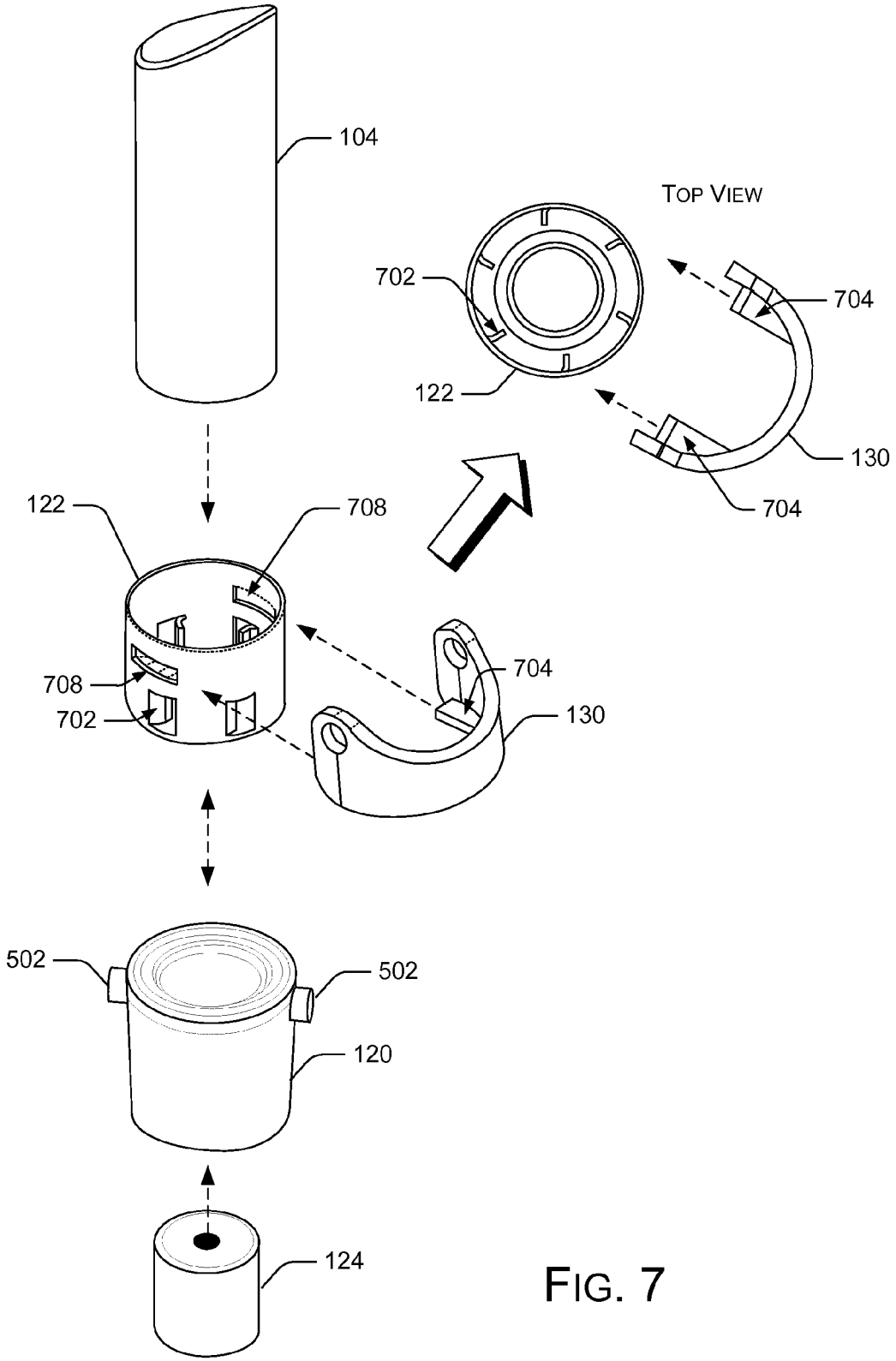
FIG. 7 is a diagram of example moving payload part of the example refillable lipstick dispenser, including magnetic catch and release components.

FIG. 7 shows exploded elements of an example moving payload 118. In an implementation, each lipstick 104 is permanently inserted into a corresponding cup 122, which may have teeth, serrations 702, or other means for grasping the base of the lipstick 104. The cup 122 is constructed at least in part of iron or a magnetic material. In one scenario, the carrier 120 contains the magnet 124. A used or depleted lipstick 104 may be removed from the refillable lipstick dispenser 100 by breaking a magnetic attachment between the cup 122 and the carrier 120. Likewise, a new lipstick 104 may be installed into the refillable lipstick dispenser 100 by allowing a new cup 122 and new lipstick 104 to magnetically bond with the carrier 120, i.e., create a magnetic catch. The extractor 130, pivotably attached to the refill cap 126, includes a fork 704 or prong formation that mates with slots 708 on the sides of the cup 122. When the extractor 130 is closed against the refill cap 126, the fork 704 is engaged with the cup 122 and is in ready state to lift the cup 122 and its lipstick 104 away from the refillable lipstick dispenser 100. When the extractor 130 is pivoted open from the refill cap 126 by the user, the fork 704 is disengaged from the slots 708 of the cup 122, and the cup 122 is free to magnetically bond to the carrier 120. Once bonded to the carrier 120, the cup 122 and lipstick 104 can be controlled by rotational motions of the tubular member 106 and the spiral sleeve 110 on the pins 502 of the carrier 120 to extend and retract the lipstick 104.

Figure 8:
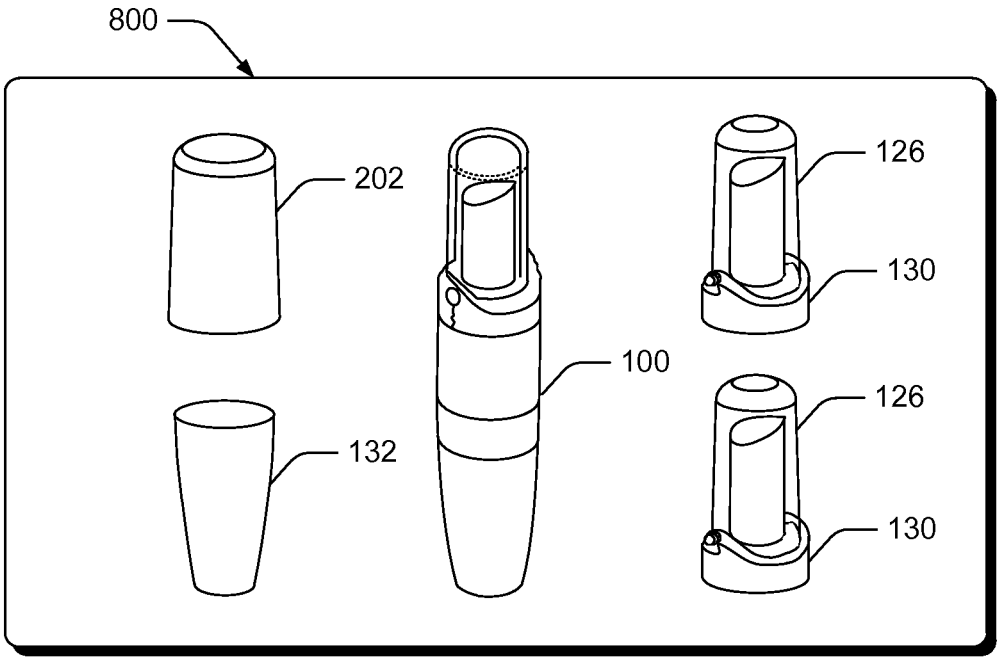
FIG. 8 is a diagram of an example kit, containing a collection of refillable lipstick components that may be provided together to a user.

FIG. 8 shows an example kit 800, containing a collection of refillable lipstick components that may be provided together to a user, e.g., for purchase. The example kit 800 contains a refillable lipstick dispenser 100, custom decorative outer shell and trim for the dispenser 100, one or more alternate lipsticks in one or more refill caps 126 with extractors 130, and a working cap 202 that may match the decorative theme of the kit 800.

Figure 9:
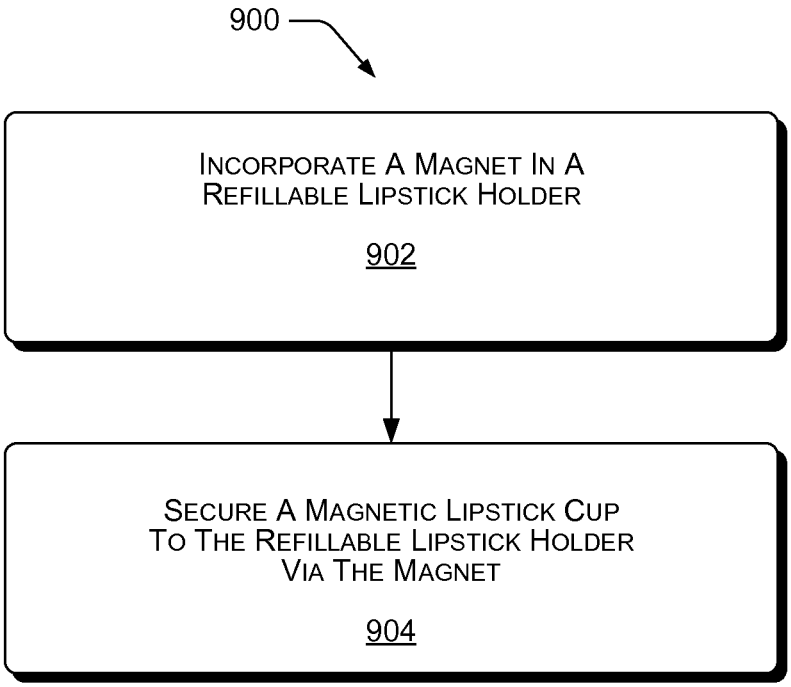
FIG. 9 is a flow diagram of an example method of constructing a refillable lipstick holder.

FIG. 9 shows an example method 900 of constructing a refillable lipstick. In the flow diagram, steps of the method are shown in individual blocks. The order of the blocks does not imply a required order for the steps of the example method 900.

At block 902, a magnet is incorporated inside a refillable lipstick holder.

At block 904, a lipstick in a magnetic cup is secured to the refillable lipstick via the magnet.

The magnetic cup can be released from the refillable lipstick holder to replace and refill the lipstick. The magnetic cup is alternately secured and released by a refill cap and extractor attached to the refill cap.

In an alternative implementation, the magnetic catch and release mechanism are replaced by another technique for holding and releasing a lipstick, such as a releasable friction fit or bayonet fitting between a cup holding the lipstick and the refillable lipstick dispenser.

CONCLUSION

Although exemplary systems have been described in language specific to structural features and/or methodological acts, it is to be understood that the subject matter defined in the appended claims is not necessarily limited to the specific features or acts described. Rather, the specific features and acts are disclosed as exemplary forms of implementing the claimed systems, methods, and structures.

What is claimed is:

1. A refillable lipstick, comprising:

a tubular member;

a removable cup in the tubular member for holding a lipstick; and a release mechanism associated with the removable cup for exchanging the removable cup with a next removable cup holding a next lipstick wherein the release mechanism further comprises a carrier moveably attached to the tubular member; and wherein the removable cup is removeably attached to the carrier, wherein the carrier is extendible and retractable for extending and retracting the removable cup and the lipstick from an end of the tubular member, and further comprising a derailer, wherein when the derailer is rotated a groove on the derailer aligns with a groove on the tubular member to allow a guide pin of the carrier to extend further from the tubular member to expose the cup and the lipstick for access and removal by an extractor on a refill cap.

2. The refillable lipstick of claim 1, wherein the removable cup is removeably attached to the carrier by one of:

a magnetic force between the removable cup and the carrier; or a friction fit between the removable cup and the carrier.

3. The refillable lipstick of claim 2, further comprising a magnet to create the removable attachment between the removable cup and the carrier.

4. The refillable lipstick of claim 1, further comprising a spiral sleeve having a spiral slot to create a swivel-up tubular member;

wherein the spiral slot contacts pins on the carrier for extending and retracting the carrier, the removable cup, and the lipstick when the spiral sleeve is rotated.

5. The refillable lipstick of claim 4, further comprising a detent at each end of the spiral slot to hold the carrier into a secured position to prevent extension or retraction of the lipstick.

6. The refillable lipstick of claim 1, further comprising a refill cap attachable to the tubular member and capable of containing the removable cup and the lipstick.

7. The refillable lipstick of claim 1, further comprising:

an extractor pivotably connected at an opening of a refill cap;

a fork on the extractor to engage sides of the removable cup;

a cam surface on the extractor to leverage the fork when the extractor is pivoted;

wherein when the extractor is pivoted toward the tubular member the extractor releases the removable cup and the lipstick from the carrier; and wherein when the extractor is pivoted away from the tubular member the extractor enables the removable cup to attach to the carrier.

8. The refillable lipstick of claim 7, wherein the extractor comprises a semi-circular lever pivotably attached to the refill cap near an opening of the refill cap.

9. The refillable lipstick of claim 7, wherein when the extractor has removed the removable cup and the lipstick from the carrier, the refill cap is detachable from the tubular member to remove the removable cup and the lipstick from the tubular member.

10. The refillable lipstick of claim 7, further comprising a next refill cap containing a next removable cup and a next lipstick; and wherein when a user attaches the next refill cap to the tubular member and the user pivots the extractor away from the tubular member, the next removable cup containing the next lipstick attaches to the carrier.

11. The refillable lipstick of claim 1, further comprising a cap attachable to the tubular member to cover an end of the lipstick when the lipstick is retracted into the tubular member.

* * * * *